US008770688B2

(12) United States Patent
Yamaguchi et al.

(10) Patent No.: US 8,770,688 B2
(45) Date of Patent: Jul. 8, 2014

(54) INK REMAINING AMOUNT DETECTING DEVICE, METHOD FOR DETECTING INK REMAINING AMOUNT, AND INK JET PRINTING APPARATUS

(75) Inventors: Kenro Yamaguchi, Noda (JP); Takashi Sugai, Noda (JP)

(73) Assignee: Canon Finetech Inc., Joso-Shi (JP)

( * ) Notice: Subject to any disclaimer, the term of this patent is extended or adjusted under 35 U.S.C. 154(b) by 0 days.

(21) Appl. No.: 13/544,704

(22) Filed: Jul. 9, 2012

(65) Prior Publication Data

US 2013/0016153 A1 Jan. 17, 2013

(30) Foreign Application Priority Data

Jul. 14, 2011 (JP) ..... 2011-155587

(51) Int. Cl.
*B41J 2/175* (2006.01)

(52) U.S. Cl.
CPC .... *B41J 2/17566* (2013.01); *B41J 2002/17573* (2013.01)
USPC ..... 347/7; 347/19; 347/86

(58) Field of Classification Search
CPC ..... B41J 2002/17573
See application file for complete search history.

(56) References Cited

U.S. PATENT DOCUMENTS

| | | | | |
|---|---|---|---|---|
| 4,275,295 | A * | 6/1981 | Menningen et al. | 250/227.21 |
| 5,754,195 | A * | 5/1998 | Yokono | 347/19 |
| 5,812,156 | A * | 9/1998 | Bullock et al. | 347/19 |
| 6,454,400 | B1 | 9/2002 | Morita et al. | 347/86 |
| 2005/0156984 | A1 * | 7/2005 | Uejima et al. | 347/19 |
| 2006/0139384 | A1 * | 6/2006 | Kitabatake et al. | 347/7 |

FOREIGN PATENT DOCUMENTS

| | | |
|---|---|---|
| JP | 2000-071471 | 3/2000 |
| JP | 2003-089218 | 3/2003 |
| JP | 2007-022032 | 2/2007 |

* cited by examiner

*Primary Examiner* — Shelby Fidler
(74) *Attorney, Agent, or Firm* — Fitzpatrick, Cella, Harper & Scinto

(57) ABSTRACT

According to the present invention, in the case where the amount of ink remaining in an ink tank is detected using light from a light emitting unit, whether or not the amount of remaining ink is smaller than a predetermined value can be accurately determined with a decrease in the life of the light emitting unit suppressed. Thus, the present invention determines a difference between output signals each output by the light receiving unit according to a corresponding one of at least two of a plurality of levels of light emissions from the light emitting unit. Based on the difference, whether or not the amount of remaining ink is smaller than the predetermined value is determined.

11 Claims, 21 Drawing Sheets

| | ELAPSED TIME FROM DATE OF MANUFACTURE | | |
|---|---|---|---|
| | 0 TO 1 MONTH | 1 TO 6 MONTHS | 6 MONTHS OR LONGER |
| | TABLE1 | TABLE2 | TABLE3 |
| LOW | Lv1<br>IF=10mA | Lv1<br>IF=10mA | Lv1<br>IF=10mA |
| MEDIUM | Lv2<br>IF=20mA | Lv3<br>IF=35mA | Lv4<br>IF=50mA |
| HIGH | Lv3<br>IF=35mA | Lv4<br>IF=50mA | Lv5<br>IF=100mA |

FIG.9

NEW INK TANK

| IF=10mA | IF=20mA | IF=35mA | TABLE 1 |
|---|---|---|---|
| 3.67ml | 3.77ml | 3.85ml | 3.80ml |

FIG.17A

INK TANK WITH ELAPSED TIME OF SIX MONTHS

| IF=10mA | IF=35mA | IF=50mA | TABLE 2 |
|---|---|---|---|
| 2.32ml | 3.05ml | 3.65ml | 3.45ml |

FIG.17B

| IF=10mA | IF=20mA | IF=35mA | IF=50mA | IF=100mA | EMBODIMENT |
|---|---|---|---|---|---|
| 85000 | 39000 | 15000 | 6500 | 2000 | 22000 |

FIG.19

INK REMAINING AMOUNT DETECTING DEVICE, METHOD FOR DETECTING INK REMAINING AMOUNT, AND INK JET PRINTING APPARATUS

BACKGROUND OF THE INVENTION

1. Field of the Invention

The present invention relates to an ink remaining amount detecting device that detects the amount of ink remaining in an ink tank, a method for detecting the amount of remaining ink, and an ink jet printing apparatus with an ink remaining amount detecting function.

2. Description of the Related Art

Ink tanks in which ink to be supplied to an ink jet printing apparatus is stored are now known to be in various forms. Examples of forms in which ink is stored in an ink tank include a sponge scheme of storing the ink in the ink tank by allowing the ink to permeate a sponge housed inside the ink tank, a real tank scheme of storing the ink directly inside the ink tank, and a bag scheme of storing the ink in a flexible bag. The sponge scheme involves the sponge placed inside the ink tank and thus a reduced amount of stored ink with respect to the volume. Furthermore, the bag scheme involves the need to protect the bag in which the ink is housed with a casing, thus reducing the amount of stored ink with respect to the overall volume. The real tank scheme has the highest volumetric efficiency. However, even ink tanks adopting the real tank scheme pose the following challenges regarding a function to detect the amount of ink remaining inside the ink tank.

In general, ink jet printing apparatuses have a function to, for example, warn a user or shut down the ink jet printing apparatus when the amount of remaining ink reaches a specified threshold value. Such a warn function, shutdown function, and the like act importantly in preventing possible inappropriate printing caused by a shortage of ink. On the other hand, the function may make a user dissatisfied with the inability to use a certain amount of ink remaining. To avoid such dissatisfaction, a remaining amount detecting device is required which can constantly accurately detect a small amount of ink.

Examples of current remaining amount detecting devices that detect the amount of ink remaining in the ink tank include a dot count scheme, a float scheme, and a prism scheme. The dot count scheme counts the number of ink ejections based on image data to calculate the amount of remaining ink based on the count value, and has the advantage of eliminating the need to add components. However, the ejection amount of nozzles may be varied by a variation in the temperature of a print head, a variation among manufactured products, or the like, resulting in a great difference between actual ink consumption and calculated ink consumption.

Furthermore, the float scheme uses a configuration in which a float migrating according to the level of the ink is placed in the ink tank and in which an optical sensor senses the position of the ink. This configuration disadvantageously requires a large space and is unsuitable for detecting a small amount of ink.

On the other hand, the prism scheme provides a triangle pole-shaped prism formed of a transparent resin member inside the ink tank so that the presence or absence of the ink is detected by detecting the presence or absence of light reflected by the prism to which the light has been delivered. An optical sensor with a light emitting element and a light receiving element irradiates the prism with light and detects reflected light. According to the prism scheme, light delivered toward the prism by the light emitting element enters the interface between the inside of the ink tank and the prism at an angle of 45°. The light entering the interface at an angle of 45° penetrates the interface between the resin and the ink, while being reflected by the interface between the resin and air due to a difference in refractive index. As a result, when an amount of ink is present, the light emitting element fails to detect light. When no ink is present, light is reflected and the reflected light is detected by the light receiving element. Thus, an output signal from the light receiving element allows the presence or absence of ink in the ink tank to be detected.

As described above, the prism scheme directly detects the position of the level and is thus more accurate than the dot count scheme. Moreover, advantageously, the prism itself can be molded integrally with other members using resin, and can thus be appropriately recycled and formed to be small.

However, the prism scheme poses the following problems. That is, if the ink tank is left stationary over a long period, the ink may adhere to the surface of the prism. As a result, even when the ink in the ink tank is exhausted, erroneous detection of the presence of ink may be caused by the ink adhering to the prism surface. To avoid such erroneous detection, emission intensity may be increased. However, disadvantageously, when the amount of remaining ink is detected with the emission intensity kept high, the life of the light emitting element is significantly shortened. Furthermore, a common method for preventing a possible increase in load on the light emitting element is to apply a water repellent to the prism surface in order to smoothly remove the ink that is in contact with the prism surface. However, precisely applying the water repellent to the prism surface is difficult, disadvantageously complicating manufacturing steps and increasing the cost of the ink tank.

Furthermore, as a method of avoiding the use of a water repellent, a technique has been disclosed which forms a groove laterally to the prism so that the capillary force of the groove can draw the ink adhering to the prism surface into the groove for removal (Japanese Patent Laid-Open No. 2000-71471). However, the technique disclosed in Japanese Patent Laid-Open No. 2000-71471 has difficulty molding a fine groove laterally to the prism and thus needs to overcome practicability and accuracy problems.

Moreover, a technique has been disclosed which sets the emission intensity of the light emitting element to a large value so that reflected light from an ink tank with the lowest reflectance can be detected based on information from the light receiving sensor (Japanese Patent Laid-Open No. 2003-89218). However, the technique disclosed in Japanese Patent Laid-Open No. 2003-89218 emits light with a high emission intensity not only to an ink tank with a low reflectance but also to an ink tank with a high reflectance. Thus, disadvantageously, the life of the light emitting element is significantly reduced.

SUMMARY OF THE INVENTION

An object of the present invention is to provide an ink remaining amount detecting device which uses a light emitting unit irradiating a reflection surface provided on an ink tank with light and a light receiving unit receiving reflected light from the reflection surface and which can accurately determine whether or not the amount of ink remaining in an ink tank has reached a specified value with a decrease in the life of the light emitting unit suppressed.

In order to accomplish this object, the present invention is configured as follows.

The present invention provides an ink remaining amount detecting device that determines whether an amount of ink remaining in an ink tank is smaller than a predetermined value, the device comprising: a reflector provided in the ink tank and in which an optical reflectance obtained in the case where the amount of ink remaining in the ink tank is smaller than the predetermined value is higher than an optical reflectance obtained in the case where the amount of ink remaining in the ink tank is equal to or larger than the predetermined value; a light emitting unit configured to generate light allowed to enter the refection surface; a light receiving unit configured to receive light reflected by the reflector and outputting an output signal according to an amount of received reflected light; a control unit configured to perform light emission control that switches an emission intensity of the light emitting unit among a plurality of levels; and a determination unit configured to determine whether or not the amount of ink remaining in the ink tank has reached the predetermined value based on the output signal output by the light emitting unit, wherein the determination unit determines whether or not the amount of ink remaining in the ink tank has reached the predetermined value based on a difference between output signals each output by the light receiving unit according to a corresponding each of at least two of the plurality of levels of light emissions from the light emitting unit.

The present invention allows light with the intensity thereof varied among the plurality of levels to enter the reflection surface of the ink tank, and determines whether or not the amount of ink remaining in the ink tank has reached the specified value based on the difference between the amounts of reflected light for the respective levels of emission intensity. Thus, even if the ink is likely to adhere to the reflection surface, whether or not the amount of ink remaining in the ink tank has reached the specified value can be accurately determined, with the emission intensity of the light emitting means suppressed. Thus, the life of the light emitting means can be improved.

Further features of the present invention will become apparent from the following description of exemplary embodiments with reference to the attached drawings.

BRIEF DESCRIPTION OF THE DRAWINGS

FIG. 9 is a diagram showing levels of emission intensity according to the present embodiment;

FIG. 17A and FIG. 17B are diagrams showing the amount of remaining ink when a threshold value for each emission intensity is reached;

FIG. 19 is a diagram showing the life of the light emitting element at each emission intensity.

DESCRIPTION OF THE EMBODIMENTS

An embodiment of the present invention will be described below with reference to the drawings.

Figure 1:
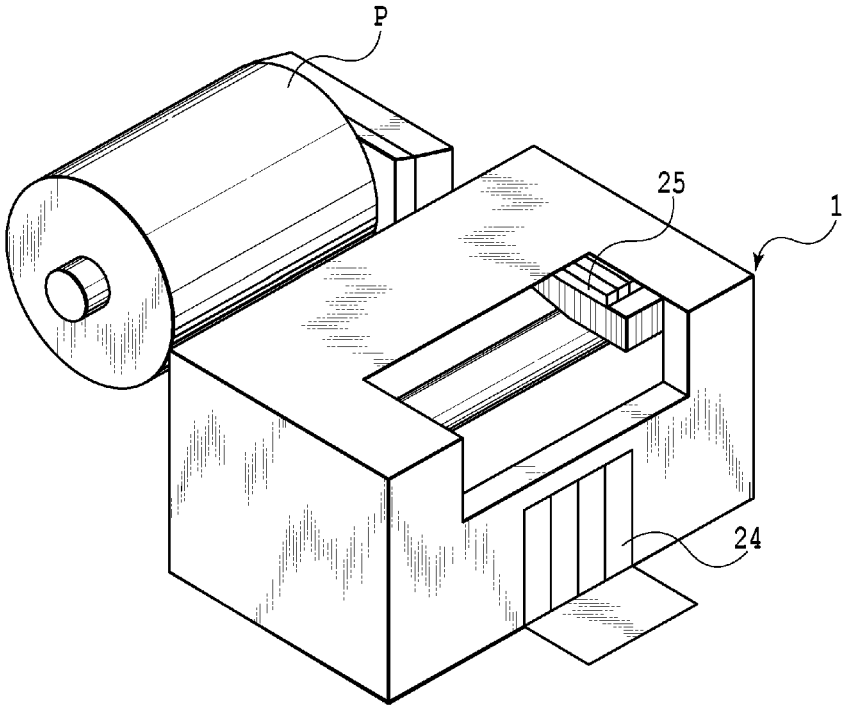
FIG. 1 is a perspective view showing an ink jet printing apparatus according to the present embodiment.

FIG. 1 is a diagram showing the external configuration of a main body section 1 of an ink jet printing apparatus (hereinafter simply referred to as a printing apparatus) according to the present embodiment. The main body section 1 of the illustrated printing apparatus includes a print head 25 that ejects ink and an ink tank 24 replaceably provided in the main body section 1 to store ink that is supplied to the print head 25. The print head 25 includes a plurality of nozzles arranged therein, and ejection energy generating elements provided in the nozzles are driven in accordance with image data to eject ink droplets through ejection ports that are openings of the nozzles. The present embodiment uses electrothermal transducing elements (heaters) as ejection energy generating elements. When the heaters are driven, ink in the nozzles is rapidly heated to about 300° C. to cause film boiling. At this time, pressure generated by bubbles causes the ink in the nozzles to be ejected through the ejection ports. Furthermore, print media P are arranged at a rear surface of the main body section 1 and each print medium P is paid out from this position, moves through a conveying path which is opposed to the ejection port of print head 25, and is discharged to the exterior.

Figure 2:
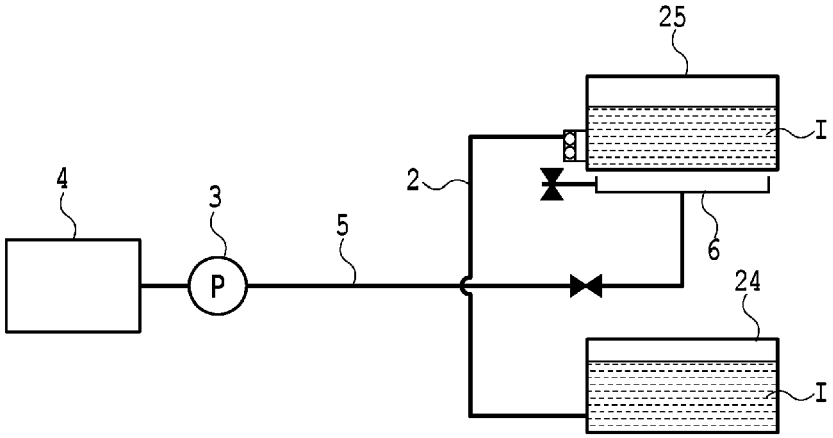
FIG. 2 is a diagram schematically showing an ink channel according to the present embodiment.

FIG. 2 is a schematic diagram of a configuration of an ink channel provided in the main body section 1. The ink tank 24 is arranged below the print head 25 in the direction of gravity and connected to the print head 25 by one ink supply channel 2. When ink 21 in the print head 25 is consumed during a printing operation, a negative pressure in the print head increases to suck up the ink 21 in the ink tank 24 into the print head 25 through the channel 2. Thus, the nozzles are filled with the ink. Furthermore, if the ink in the ink tank 24 is consumed and the amount of ink remaining in the ink tank 24 is smaller than a predetermined value, a user needs to be visually or acoustically warned. If the amount of remaining ink further decreases, the printing operation needs to be stopped. Given that the warning operation is not performed or the controllable stoppage of the printing operation as described above is not performed and the printing operation is continued with no ink remaining, the following problems may occur.

(i) When the ink in the channel 2 is consumed and air enters the channel 2 to eliminate the water head difference between the level of the ink and the surface of the nozzles, the force of the nozzles acting to hold the ink decreases. Then, the ink may leave the nozzles and stain the conveying path for the print medium or the print medium itself.

(ii) When the ink is continuously ejected with no ink remaining, the ink in the nozzles is also exhausted and heat from the heaters is excessively accumulated, making the heaters defective.

Thus, if the amount of remaining ink decreases to zero, a warning needs to be issued or the printing operation needs to be automatically stopped. To that end, if the amount of ink remaining in the ink tank 24 reaches a predetermined value, this needs to be accurately detected.

Figure 3:
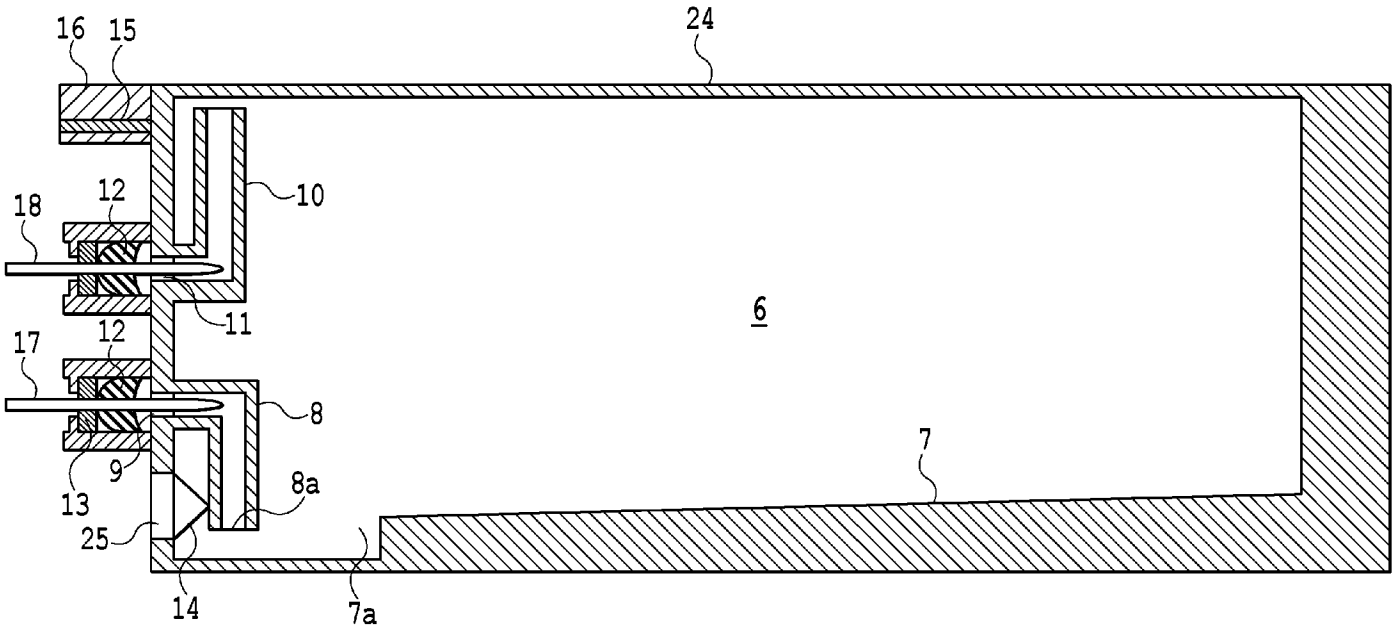
FIG. 3 is a cross-sectional view showing a configuration of an ink tank according to the present embodiment.

To accurately determine whether or not the amount of ink remaining in the ink tank 24 is smaller than a predetermined value, the present embodiment optically detects the amount of remaining ink. Thus, according to the present embodiment, the ink tank is configured as shown in FIG. 3. In FIG. 3, the ink tank 24 includes a liquid chamber 6 in which the ink is stored, an injection port 9 through which the ink is introduced into the main body section of the ink jet printing apparatus, and a ink supply pipe 8 through which the ink stored in the liquid chamber 6 is fed to the injection port by a capillary force. Moreover, the ink tank 24 includes an atmospheric communicating port 11 that makes the internal pressure of the ink tank 24 equivalent to the atmospheric pressure and a prism 14 serving as a reflector to allow an optical sensor provided in the main body to sense the amount of remaining ink.

The liquid chamber 6 includes an inclined surface 7 at the bottom thereof so that the amount of remaining ink is minimized when the printing operation is stopped as a result of detection of an ink exhausted state. The ink is guided to an opening end 8*a* of the supply pipe 8 arranged inside the ink tank 24. Moreover, to deal with a slight variation in the detection of the ink exhausted state, a recessed portion 7*a* recessed downward from the inclined surface 7 is formed near the opening end 8*a* of the supply pipe. Thus, even with a slight variation in the detection of the ink exhausted state, entry of air into the channel can be avoided which may result from consumption of the ink in the recessed portion 7*a*.

The injection port 9 and the atmospheric communicating port 11 are closed by a slitted rubber stopper 12 during transportation to prevent possible entry of the outside air and leakage of the ink. When the ink tank 24 is installed in the main body section 1 of the printing apparatus, a hollow metal needle-like joint section 17 pushes its way through the slit in the rubber stopper 12 into the ink tank 24 to cancel the closed state of the ink tank 24. When the main body section 1 of the printing apparatus is thus connected to the ink tank 24, the ink is supplied to the print head 25 through the injection port 9 in the ink tank 24 via the needle-like joint section 18. Moreover, the space in the ink tank 24 communicates with the air via the needle-like joint section 18 to admit the air into the ink tank through the atmospheric communicating port 11.

Furthermore, in the ink tank 24, a nonvolatile storage element 15 is provided above the atmospheric communicating port 11. The nonvolatile storage element 15 includes an EEPROM substrate and is bonded to a protective case 16. When the ink tank 24 is installed in the main body section 1, the storage element 15 comes into contact with a read terminal (not shown in the drawings) on the main body section 1 so that a CPU provided in the main body section 1 and described below can write and read information to and from the storage element. The following are written to the storage element 15: information such as the colors of the ink housed in the ink tank 24, the date of manufacture of the ink tank 24, and the manufacturer' serial number of the ink tank 24, as well as data on the consumption of ink transmitted from the main body section 1. The consumption of ink is data calculated using the dot count scheme of counting the cumulative total number of times that ink in each color is ejected based on printed image data. Additionally, the amount of ink consumed during a recovery operation of sucking the ink from the nozzles to recover the ejection performance of the nozzles may be converted into an ejection-equivalent amount, which may then be added to a dot count value for a printing operation. The read terminal contacting the EEPROM and the CPU described below form read means. In addition, the present embodiment performs an operation of recovering the print head 25 by covering the ejection port in the print head 25 with a cap 6 shown in FIG. 2 and allowing a pump 3 to generate a negative pressure inside the cap 6 to suck the ink through the nozzles. Thus, new ink suitable for printing is filled into the nozzles, and waste ink sucked through the nozzles is discharged into a waste ink tank 4.

Now, a general configuration of a control system provided in the ink jet printing apparatus according to the present embodiment will be described based on FIG. 4.

Figure 4:
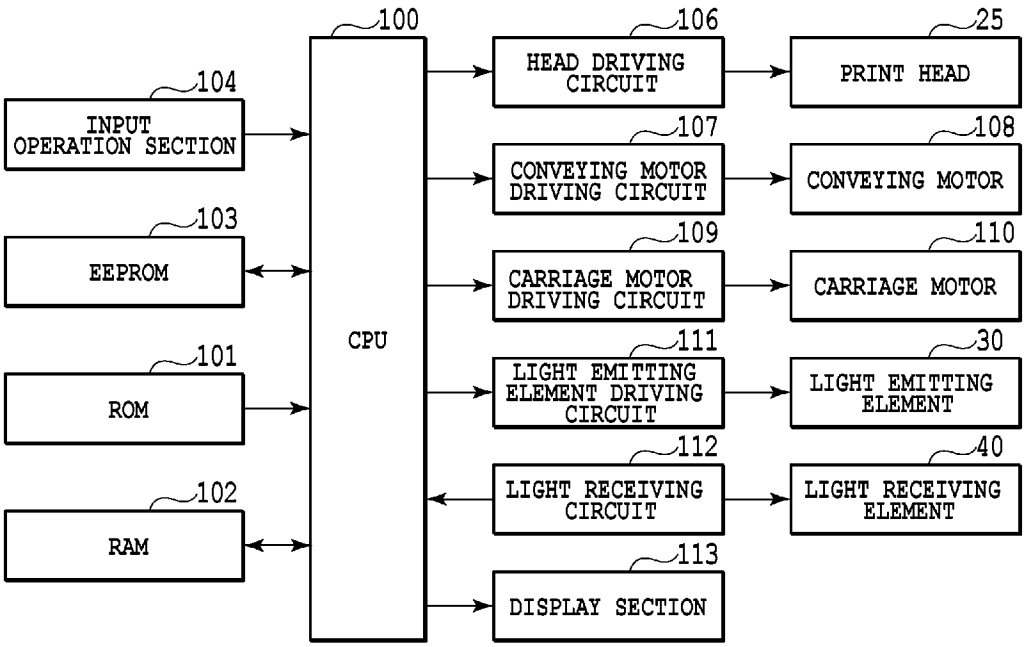
FIG. 4 is a block diagram showing a general configuration of a control system according to the present embodiment.

In FIG. 4, a CPU 100 carries out various types of processing such as calculations, counting, clocking, determinations, and control to control different sections of the ink jet printing apparatus, in accordance with programs stored in a ROM 101. Furthermore, the CPU 100 contains a timer that performs a clocking operation. A RAM 102 temporarily stores various data such as data input via an input operation section 104 or the like and also serves as a work area that temporarily holds data when the CPU 100 carries out processing. Additionally, the CPU 100 connects to a head driving circuit 106 that drives the print head 25, a conveying motor driving circuit 107 that drives a conveying motor 108, a carriage motor driving circuit 109 that drives a carriage motor 110, and the like. Moreover, the CPU 100 is connected to a light emitting element driving circuit 111 that drives a light emitting element 30 described below and to a light receiving circuit 112 that outputs an output signal (output voltage) corresponding to the amount of reflected light received by a light receiving element 40; the reflected light is originally emitted by the light emitting element 30. Moreover, the CPU 100 includes a display section 113 that displays the state of the ink jet printing apparatus.

Now, the configuration and operation of the detecting device that detects the amount of remaining ink according to the present embodiment will be described in detail.

As shown in FIG. 3, the ink tank 24 according to the present embodiment includes a triangle pole-shaped prism (reflector) serving as a reflector in which the optical reflectance thereof obtained in the case where the amount of ink remaining in the ink tank 24 is smaller than a predetermined value is higher than the optical reflectance thereof obtained in the case where the amount of ink remaining in the ink tank 24 is equal to or larger than the predetermined value. The prism 14 is formed of a transparent material similar to a transparent material forming the other sections of the ink tank 24. The prism 14 has a refractive index of at least 1.40 and less than 1.87. According to the present embodiment, the prism 14 is desirably formed of a resin material which can be molded integrally with the other sections of the ink tank 24 and which is suitable for recycling. According to the present embodiment, the prism 14 is formed of transparent polypropylene. Polypropylene is suitable for formation of the prism 14 because of a refractive index of 1.48 and high resistant to ink. As shown in FIG. 7A to FIG. 7D, the prism 14 has a cross section shaped like a right-angled isosceles triangle and is arranged so that a ridge where two orthogonal slopes 14*a* and 14*b* intersect each other projects from an inner wall of the ink tank 24 toward the interior of the liquid chamber. The slope 14*a* is arranged below the slope 14*b*.

Figure 5:
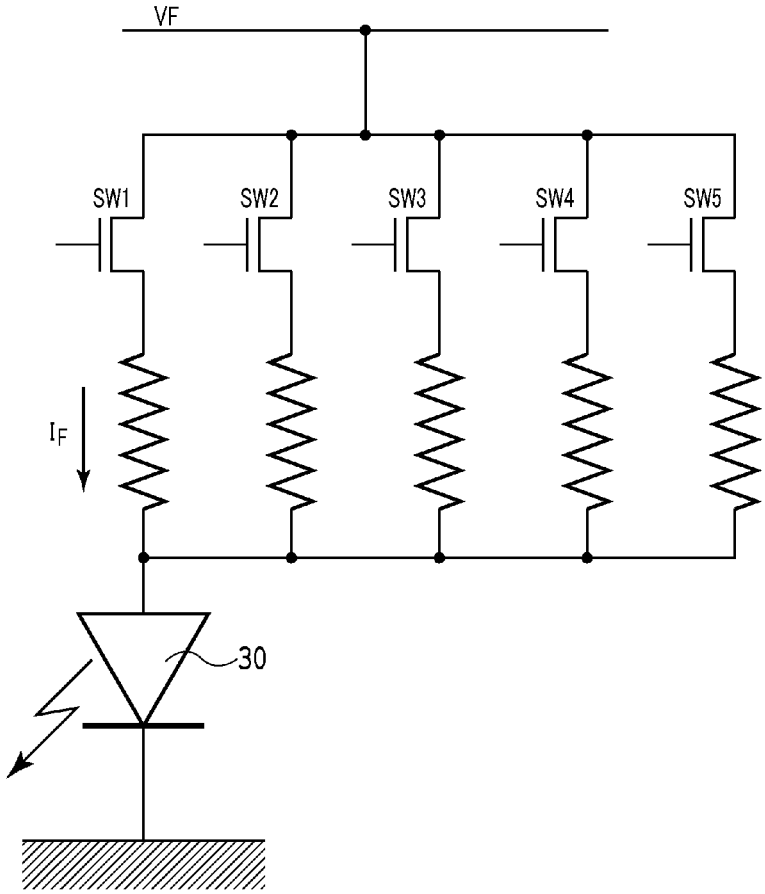
FIG. 5 is a diagram showing a drive circuit for a light emitting element according to the present embodiment.

Furthermore, an optical sensor 50 with a light emitting element 30 and a light receiving element 40 (see FIG. 7A to FIG. 7D) is arranged on the main body section 1 opposite an outward facing bottom surface of the prism 14, that is, a surface 14*c* located opposite the ridge between the slopes 14*a* and 14*b*. The light emitting element 30 is formed of a light emitting diode 30, and a plurality of different resistors R1, R2, R3, and R4 are connected in parallel with the light emitting diode 30 on a cathode side thereof, as shown in FIG. 5. The light emitting diode 30 can be allowed to emit light by applying a voltage of about 3.3 V from the main body section 1 of the printing apparatus to the light emitting diode 30. According to the present embodiment, the light emitting diode 30 emits infrared light with a wavelength of 900 nm. Light with a large wavelength such as infrared light is unlikely to be scattered and to be absorbed due to the absorption spectrum of the ink. This property of the infrared light acts advantageously on the adhesion of an ink film to the prism 14 described below.

The present embodiment can perform light emission control so as to switch the emission intensity of the light emitting diode 30 among a plurality of levels by switching among the plurality of resistors to allow one of the resistors to be used. For example, a driving circuit for the light emitting diode 30 shown in FIG. 5 turns on one of switching elements SW1 to SW5 to allow the corresponding one of the resistors R1 to R5 to be used as a current limiting resistor. Thus, a current IF can be changed among the five levels. The switching among the switching resistors SW1, SW2, SW3, SW4, and SW5 is carried out by the CPU 100 provided in the main body of the ink jet printing apparatus.

Figure 7A:
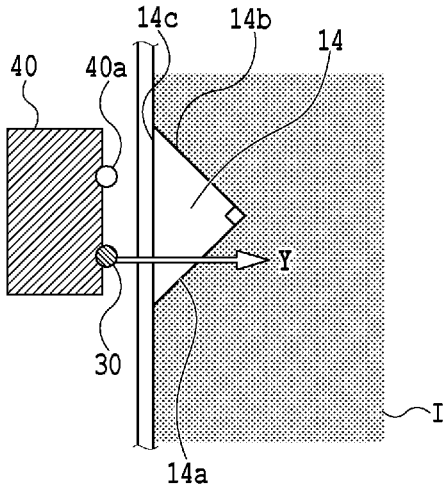
FIGS. 7A to 7D are diagrams showing behavior of light observed when the light enters a prism.

Light emitted by the light emitting diode 30 perpendicularly enters the bottom surface of the prism 14 and passes through the interior of the prism 14. As shown in FIG. 7A, the light enters the slope 14*a* of the prism 14 at an angle of 45°.

In general, when light from a substance with a refractive index nB enters a substance with a refractive index nA at an angle θm, the incident light is reflected by an interface between the two substances provided that the following condition holds true.

$$\sin \theta m = \sin \theta m / \sin 90° \geq nA/nB \quad \text{(Expression 1)}$$

Here, when the condition according to the present embodiment is applied to Expression 1, since θm=45° and nB=1.46 (the refractive index of resin of the prism), the condition that light having entered the prism 14 is totally reflected by the slope 14*a* is as shown by:

$$nA \leq nB/\sin \theta m = 1.46/\sin 45° = 1.05 \quad \text{(Expression 2)}$$

Figure 7B:
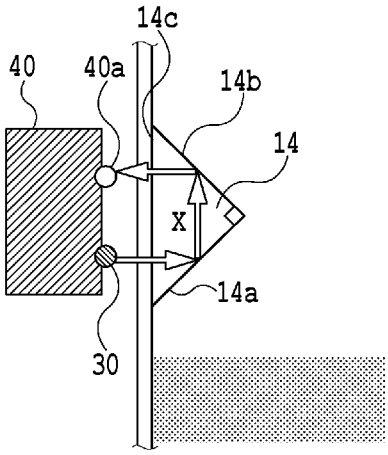
Figure 7C:
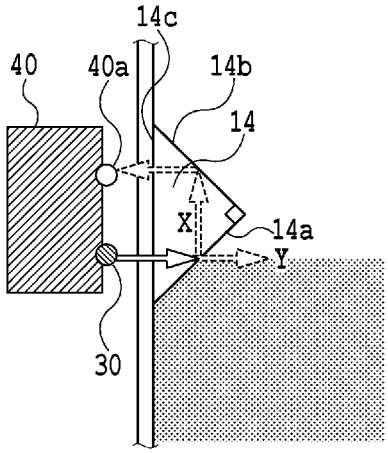
Figure 7D:
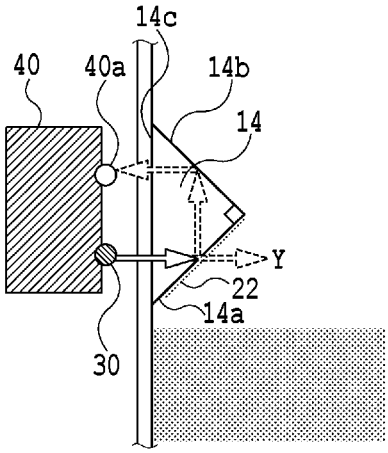

Thus, if the substance adjacent to the prism 14 has a refractive index of at most 1.05, the light is reflected in an X direction shown in FIG. 7B. If the substance adjacent to the prism 14 has a refractive index of less than 1.05, the light passes through the prism 14 (travels in a Y direction). The air has a refractive index of 1.00 and the ink has a refractive index of about 1.3, which is close to the refractive index of the air. Hence, if the air is present around the reflection surface 14*a* of the prism 14, the incident light is reflected by the reflection surface 14*a* in the X direction. Furthermore, if the ink is present around the reflection surface 14*a*, the incident light passes through the reflection surface 14*a* and into the ink (travels in the Y direction (see FIG. 7A and FIG. 7C)). Moreover, as shown in FIG. 7D, the incident light reflected by the reflection surface 14*a* is also reflected by the reflection surface (slope) 14*b*, which is orthogonal to the reflection surface (slope) 14*a*, and enters the light receiving element 40.

If the ink is stored in the ink tank up to a height equal to or greater than the height of the point (light spot) on the reflection surface 14*a* of the prism 14 where the prism 14 is irradiated with the light from the light emitting element, the incident light is prevented from entering the light receiving element 40 as shown in FIG. 7A. In contrast, if ink is consumed down to a height smaller than the height of the light spot on the reflection surface 14*a* of the prism 14 where the prism 14 is irradiated with light from the light emitting element 30, the incident light is reflected by the reflection surfaces 14*a* and 14*b* and received by the light receiving element 40 as shown in FIG. 7B. That is, the optical reflectance of the prism 14 varies depending on whether or not the height of level of the ink is equal to or greater than the height of the light spot.

Figure 6:
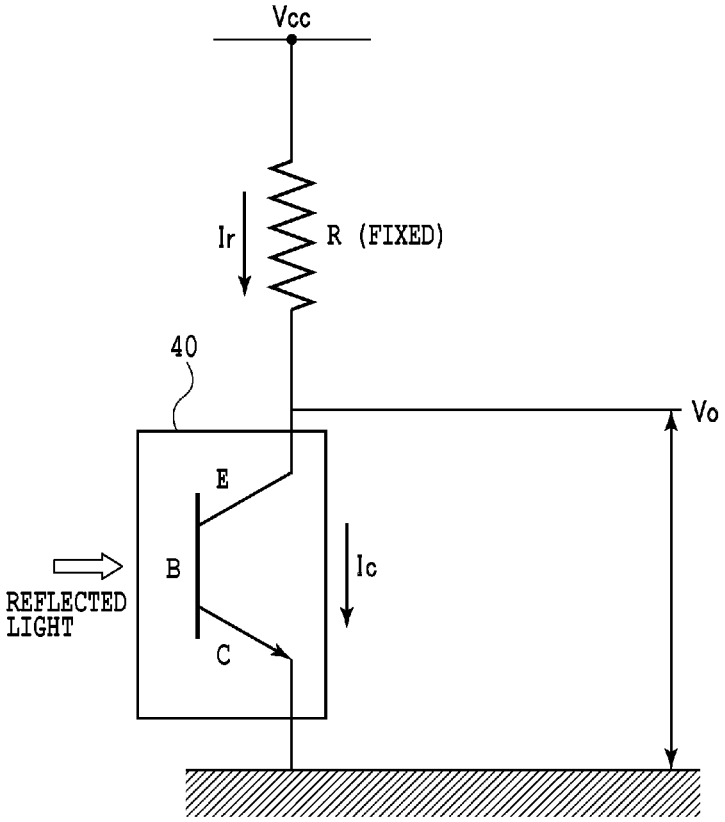
FIG. 6 is a diagram showing a light receiving circuit according to the present embodiment.

Now, a light receiving and detecting circuit for use in the present embodiment will be described based on FIG. 6.

The light receiving and detecting circuit for use in the present embodiment includes the light receiving element 40 formed of a phototransistor and a resistor R connected to a collector (C) of the phototransistor 40. A power supply voltage Vcc is applied to between one end of the resistor R and an emitter (E) of the phototransistor 40.

Figure 12:
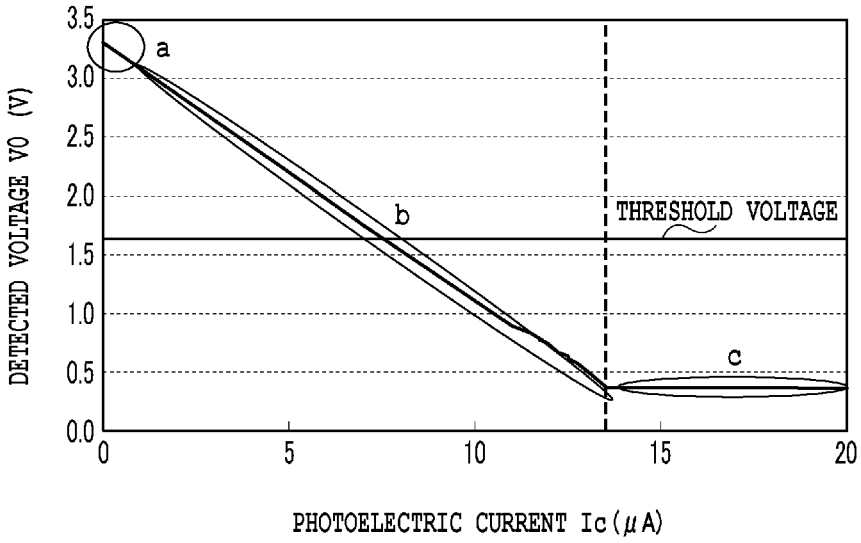
FIG. 12 is a diagram showing the relationship between a photoelectric current and the detected voltage of the light receiving circuit shown in FIG. 6.

The phototransistor 40 includes a light receiving section positioned so as to be able to receive reflected light from the reflection surface 14*b* of the prism 14. A current (photoelectric current Ic) flows between the collector and emitter of the phototransistor 40. The power supply voltage Vcc is 3.3 V. The CPU 100 detects a voltage Vo between the collector and the emitter. The detected voltage Vo is the difference in voltage between the power supply voltage Vcc and a voltage drop caused by the resistor R. That is, Vo=Vcc−Ir×R. FIG. 12 shows the relationship between the photoelectric current Ic and the detected voltage Vo. The photoelectric current Ic flowing through the phototransistor 40 is the same as the current Ir flowing through the resistor R. Thus, an increase in photoelectric current Ic increases the voltage drop in the resistor R, while reducing the detected voltage Vo. The maximum value Irmax of the current flowing through the resistor R is equal to V/R, and thus the detected voltage Vo is saturated when close to zero (in FIG. 12, about 0.3 V). A flow of a larger amount of photoelectric current Ic is prevented from reducing the detected voltage Vo. That is, after at least a certain specified amount of reflected light enters the phototransistor 40, the detected voltage remains almost the same. Thus, whether or not light from the prism 14 has entered the light receiving section (light receiving unit) 40*a* of the phototransistor 40 is determined by comparing the detected voltage Vo with a preset threshold voltage to determine whether or not the detected voltage value Vo is lower than the threshold voltage. That is, the present embodiment detects the presence or absence of ink depending on the amount of light entering the light emitting section (light emitting unit) 40*a* of the phototransistor 40.

Figure 8:
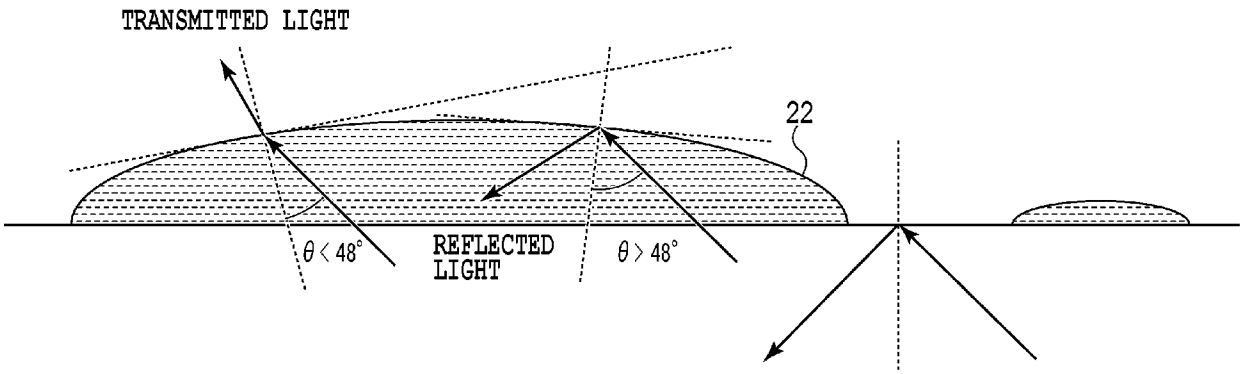
FIG. 8 is a diagram showing behavior of light at or near an ink film on a prism surface.

However, if the prism 14 is used to detect the presence or absence of ink in the ink tank 24, the presence is erroneously detected depending on the state of the ink in contact with the prism 14. For example, when the ink is fixed to the prism surface to form an ink film, if the ink in the liquid chamber is exhausted, the ink film formed on the prism surface may cause the presence of ink to be erroneously detected. Such a phenomenon is likely to occur when the ink tank 24 is left unattended for a long period or when ink with a low capillary force is stored in the ink tank 24. FIG. 8 is a diagram showing that an ink film is formed on the surface of the prism 14. As shown in FIG. 8, light having entered the ink film is reflected by the interface between the ink film and the air or passes through the interface. This is because the normal of the interface between the ink film and the air varies, making the incident angle, the angle between the incident light and the normal nonuniform, as shown in FIG. 8. That is, a portion of the light having entered the interface between the ink film and the air which has an incident angle of at most 45° is reflected by the interface between the ink film and the air and reenters the prism 14. A portion of the light having entered the interface between the ink film and the air which has an incident angle of less than 45° passes through the interface and is prevented from reentering the prism 14. Moreover, the ink film may be formed only on a part of the surface of the prism 14, and light delivered to a part of the surface on which the ink film is not formed enters the light receiving section 40*a* of the phototransistor 40.

Thus, in a situation where an ink film is formed on the surface of the prism 14, the amount of light entering the light receiving section 40*a* is unstable. A variation in the amount of light received may cause an error in the detection of the amount of remaining ink. That is, the amount of ink entering the light receiving section 40*a* is smaller when an ink film is formed on the prism 14 than when no ink film is formed on the prism 14. Hence, even with the ink in the ink tank 24 exhausted, the presence of ink may be erroneously detected. The amount of decrease in the amount of light received is significantly affected by the degree of adhesion of the ink film (the thickness of the film and the area of the light spot), the type of the ink (light absorption property), and the amount of light from the light emitting diode 30. In contrast, if both the emission intensity of the light emitting diode 30 and the amount of light received by the light emitting section 40*a* are increased, then even with an ink film formed on the surface of the prism 14, the amount of light received by the light emitting section 40*a* can be increased. This enables possible erroneous detection to be prevented. However, the increased emission intensity causes the light emitting diode to be prematurely degraded, reducing the life of the light emitting diode.

Thus, the present embodiment enables the emission intensity of the light emitting diode to be switched among a plurality of levels so that the emission intensity is increased only at the appropriate timing. This prevents erroneous detection caused by an ink film formed on the surface of the prism 14, thus precluding the life of the light emitting diode 30 from being reduced.

FIG. 9 shows the emission intensity level of the light emitting diode 30 for use in the present embodiment. The present embodiment enables the emission intensity to be adjusted among five levels LV1 to LV5. The emission intensity is adjusted by switching a current limiting resistance (R1 to R5) and a forward current IF. The present embodiment selects three of the five levels of forward current IF and switches among the selected forward currents as necessary to detect the amount of remaining ink. Processing of selecting three of the five levels of forward current is based on the elapsed time from the date of manufacture to the current time. That is, one of the three levels of forward current is selected so that the ink tank 24 with a longer elapsed time involves light with a higher emission intensity when the amount of remaining ink is detected. The elapsed time of the ink tank 24 is calculated by the CPU 100 in the control system described below based on the date of manufacture of the ink tank 24 written to the EEPROM 103 provided in the ink tank 24 and the time measured by a timer 105 provided in the main body section 1 of the printing apparatus. Furthermore, the selection of the forward current based on the elapsed time, that is, the selection of the emission intensity, is carried out by the CPU 100 selecting one of the tables 1 to 3 shown in FIG. 9.

Figure 10:
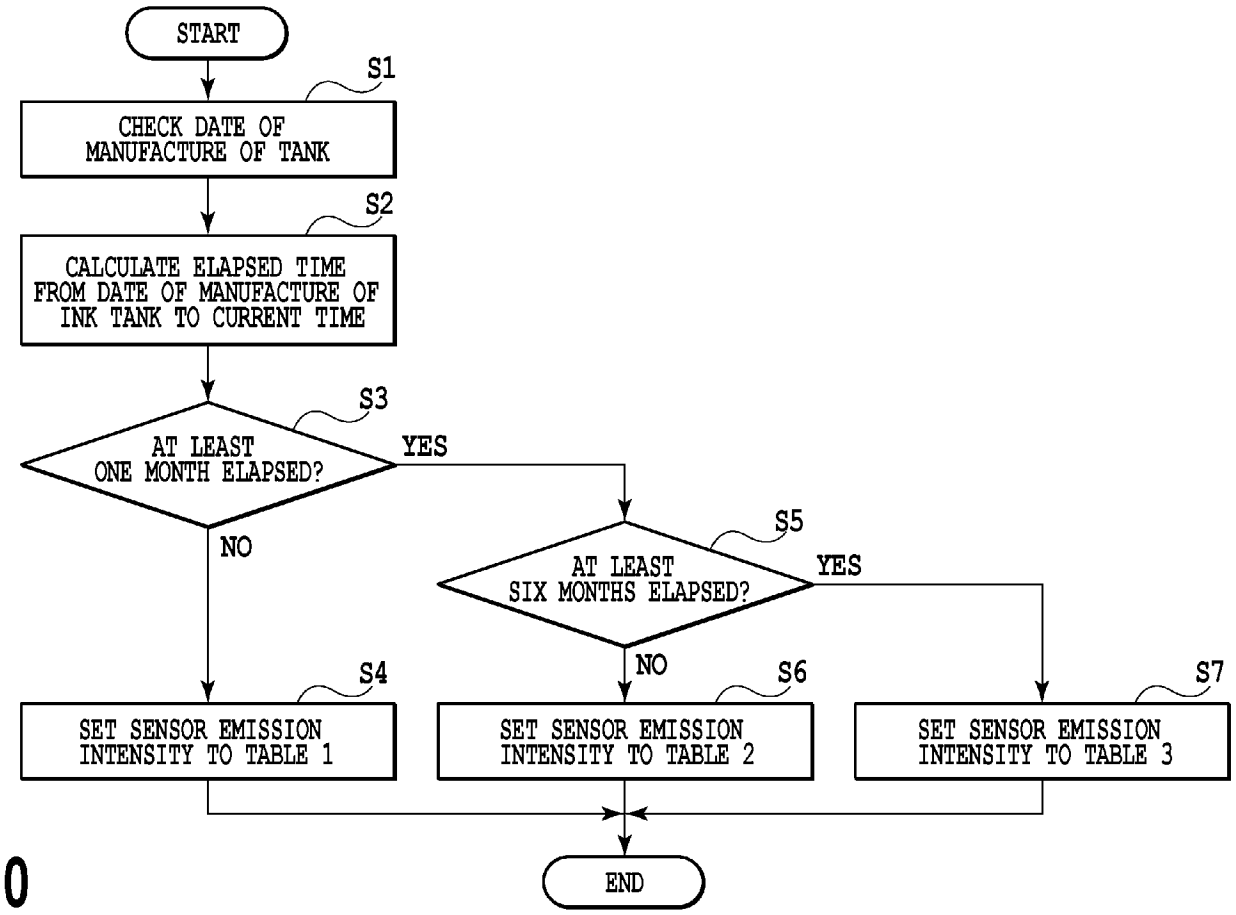
FIG. 10 is a flowchart showing processing of selecting an emission intensity table.

FIG. 10 shows processing of selecting a table of data indicative of the emission intensity of the light emitting diode 30 which processing is carried out before starting a printing operation. First, the CPU 100 reads the date of manufacture of the ink tank 24 from the EEPROM 103 (step S1). Then, the CPU 100 compares the time measured by the built-in timer with the date of manufacture of the ink tank 24 to calculate how long time has elapsed since the date of manufacture (step S2). Thereafter, based on the elapsed time, a table for use in changing the emission intensity of the light emitting diode 30 among the three levels, low, medium, and high, is selected from three types of tables 1 to 3. That is, if the elapsed time is shorter than one month, the table 1 shown in FIG. 9 is selected (steps S3 and S4). If the elapsed time is at least one month and shorter than six months, the table 2 is selected (steps S5 and S6). If the elapsed time is at least six months, the table 3 is selected (steps S6 and S7).

If the processing from step S1 to step S7 selects the table 1, Lv1 is selected as the low emission intensity, Lv2 is selected as the medium emission intensity, and Lv3 is selected as the high emission intensity. The emission intensity Lv1 is obtained by setting the forward current IF through the light emitting diode 30 to 10 mA. Furthermore, the emission intensity Lv2 is obtained by setting IF to 20 mA, and the emission intensity Lv3 is obtained by setting IF to 30 mA. An emission intensity Lv4 is obtained by setting IF to 35 mA, and an emission intensity Lv5 is obtained by setting IF to 50 mA. Thus, if the table 1 is selected, currents of 10 mA, 20 mA, and 35 mA are set in order to obtain the three levels of emission intensity, the low, medium, and high emission intensities. Furthermore, if the table 2 is selected, currents of 10 mA, 35 mA, and 50 mA are set in order to obtain the low, medium, and high emission intensities. If the table 3 is selected, currents of 10 mA, 50 mA, and 100 mA are set in order to obtain the low, medium, and high emission intensities. Thus, according to the present embodiment, the higher emission intensities are used for the ink tank with a longer elapsed time. This is because the ink in contact with the prism for a longer period is more likely to adhere to the surface of the prism 14. According to the present embodiment, the amount of light emitted by the light emitting diode 30 in terms of radiant flux is 0.4 mW for Lv1, 0.9 mW for Lv2, 1.5 mW for Lv3, 2.4 mW for Lv4, and 5.2 mW for Lv5. The radiant flux is used as a unit of the amount of light because the light emitting element used in the present invention involves invisible light such as infrared light, so that the use of the radiant flux, the amount of light irrelevant to wavelength, is determined to be more appropriate than the use of a unit such as illuminance, which is affected by visibility.

Now, the detection of the amount of ink remaining in the ink tank 24 during a printing operation will be described.

Figure 11:
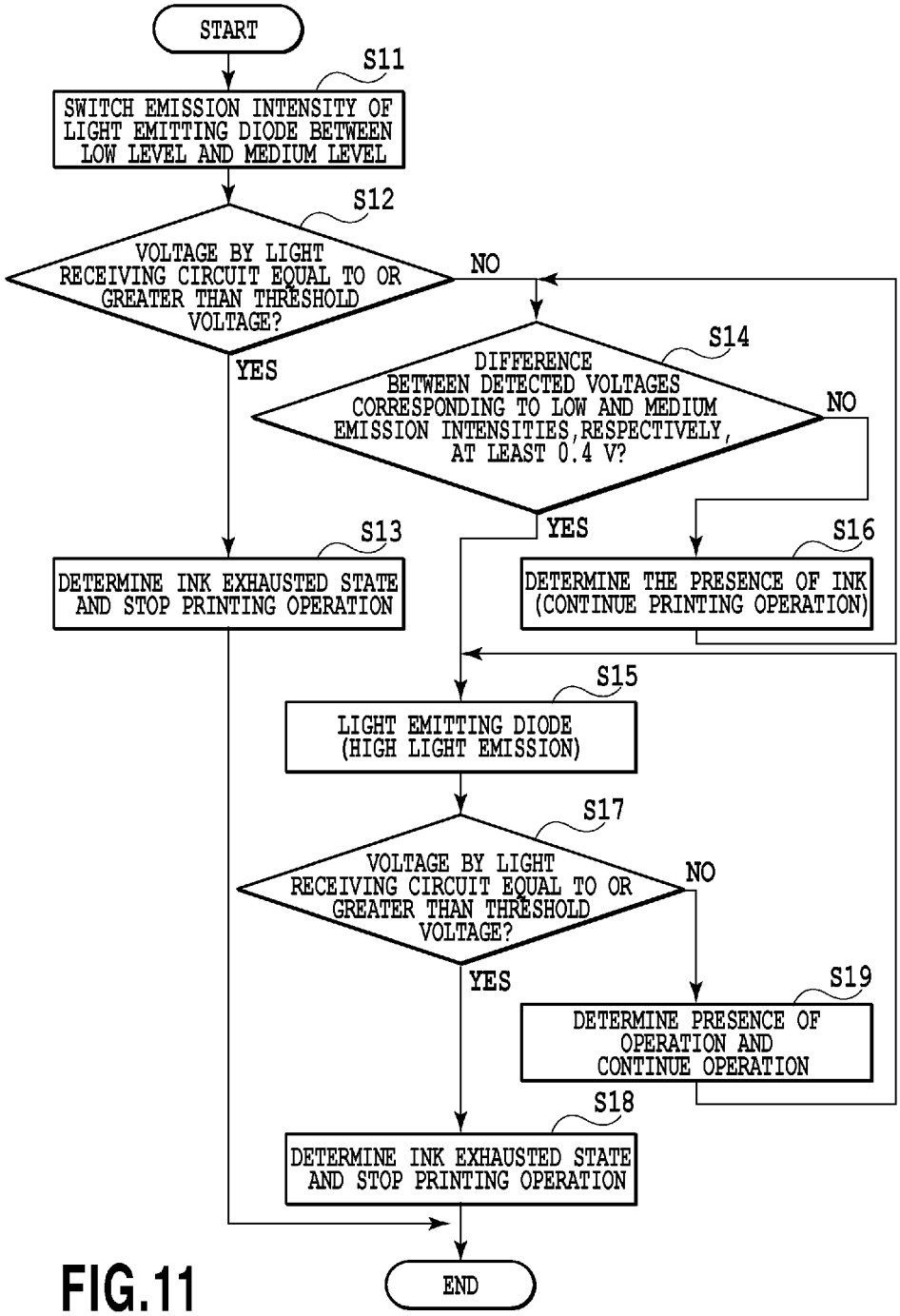
FIG. 11 is a flowchart showing a control operation based on each table according to the present embodiment.

During a printing operation, the emission intensity of the light emitting diode 30 is switched among the three levels, that is, the low, medium, and high levels as necessary to detect the amount of remaining ink, as shown in a flowchart in FIG. 11. First, in step S11, the emission intensity of the light emitting diode 30 is switched between the two levels, that is, the low and medium levels. The switching between the low level and the medium level is carried out at a period of 100 msec. The switching is carried out at a period of 100 msec because the volumetric flow rate of ink from the ink tank 24 has a maximum value of 1.0 ml/sec, so that the switching at a period of 100 msec allows the amount of remaining ink to be detected at an error of about 0.1 ml, resulting in a sufficient detection accuracy. The current limiting resistance of the light emitting diode can be switched (switching elements SW1 to SW5) can be switched at a period of at most 10 msec, and the phototransistor 40, the light receiving element, has a response speed of about 0.01 msec. Thus, switching at a shorter period enables a higher detection accuracy to be achieved.

Thereafter, in step S12, the CPU 100 determines whether or not an output voltage from the phototransistor 40 (the voltage between the collector and emitter of the phototransistor 40) is equal to or smaller than a preset threshold value, and if the output voltage is equal to or smaller than the preset threshold value, determines that the ink is exhausted to stop the printing operation (step S13). Furthermore, in step S12, if the detected voltage of the phototransistor 40 exceeds the threshold value, the CPU 100 shifts to step S14.

In step S14, the CPU 100 compares the detected voltage Vo obtained if the emission intensity is low with the detected voltage Vo obtained if the emission intensity is medium to determine whether or not the difference between these detected voltages (voltage difference) has reached a preset specified value (for example, 0.4V). If the voltage difference is smaller than the specified value, the CPU 100 determines that an amount of ink is present in the ink tank to continue the printing operation. Then, the processing in steps S14 and S16 is repeated until in step S14, the voltage difference between the detected voltage Vo obtained if the emission intensity is low and the detected voltage Vo obtained if the emission intensity is medium becomes equal to the specified value.

Furthermore, in step S14, if the voltage difference is determined to be equal to or greater than the specified value, the CPU 100 determines that although the ink is exhausted, that is, the level of the ink is below the light spot of the prism 14, an ink film may be formed on the prism. In this case, in step S15, the CPU 100 sets the emission intensity of the phototransistor 40 to the high level. That is, the forward current IF through the light emitting diode 30 is set according to one of the tables 1, 2, and 3 in FIG. 9.

As described above, the present embodiment determines whether or not the voltage difference between the detected voltage Vo obtained if the emission intensity is low and the detected voltage Vo obtained if the emission intensity is medium is equal to the specified value, and according to the result of the determination, determines whether or not an ink film is formed on the surface of the prism. The determination based on the potential difference can be achieved for the following reason.

Figure 13:
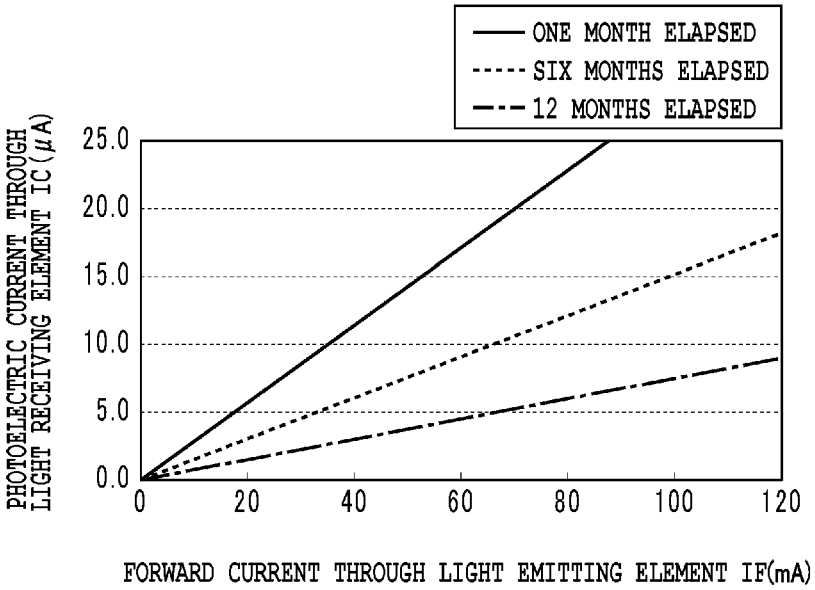
FIG. 13 is a diagram showing the relationship between a forward current through the light emitting element and the amount of light received for each elapsed time from the date of manufacture.
Figure 14:
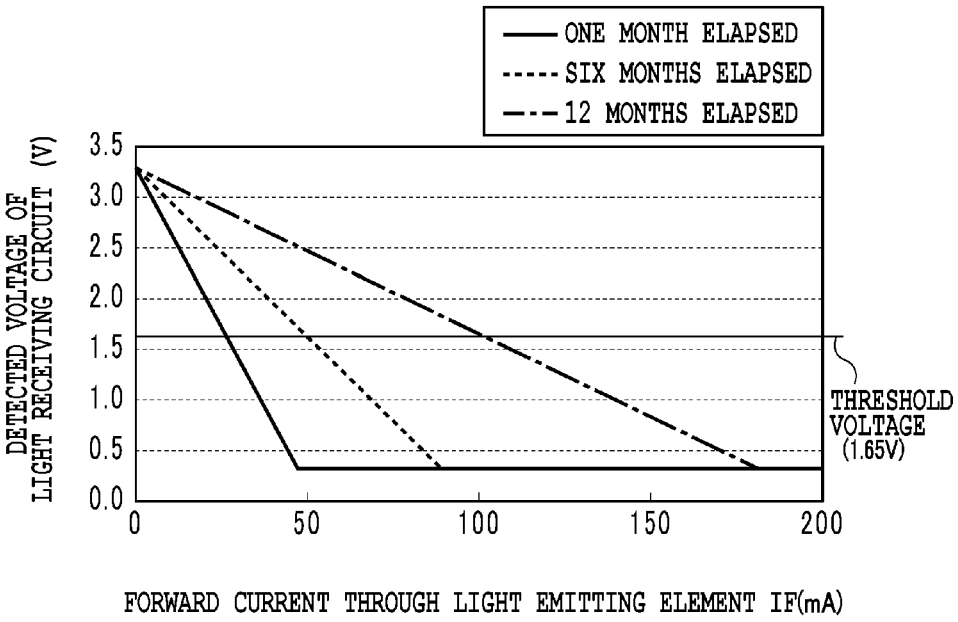
FIG. 14 is a diagram showing the relationship between the emission intensity and the detected voltage of the light receiving circuit for each elapsed time from the date of manufacture.

First, with reference to FIG. 13, the relationship between the forward current flowing through the light emitting diode 30 and the photoelectric current Ic simultaneously flowing through the phototransistor 40, the light receiving element 40. FIG. 13 shows the characteristics of the photoelectric current Ic observed immediately after the level in the ink tank 24 falls below the position (spot) on the reflection surface 14*a* of the prism where the prism is irradiated with light from the light emitting diode 30, that is, in a situation where an ink film is most likely to adhere to the prism. FIG. 13 shows the relationship between the forward current IF and the photoelectric current Ic for different elapsed times between the date of manufacture of the ink tank 24 and the current time. As seen in FIG. 13, the photoelectric current Ic increases consistently with the forward current IF. Furthermore, the photoelectric current Ic tends to decrease with increasing elapsed time from the date of manufacture of the ink tank 24. This tendency indicates the impact of an ink film formed on the prism surface. Additionally, in the ink exhausted state where the level in the ink tank 24 is below the above-described spot, a large current value Ic is obtained at a small forward current IF, that is, a low emission intensity. FIG. 14 shows the relationship between the emission intensity of the light emitting diode 30 and the detected voltage of the phototransistor 40 (the voltage between the emitter and collector of the phototransistor 40), which relationship is derived based on the above-described results.

Figure 15A:
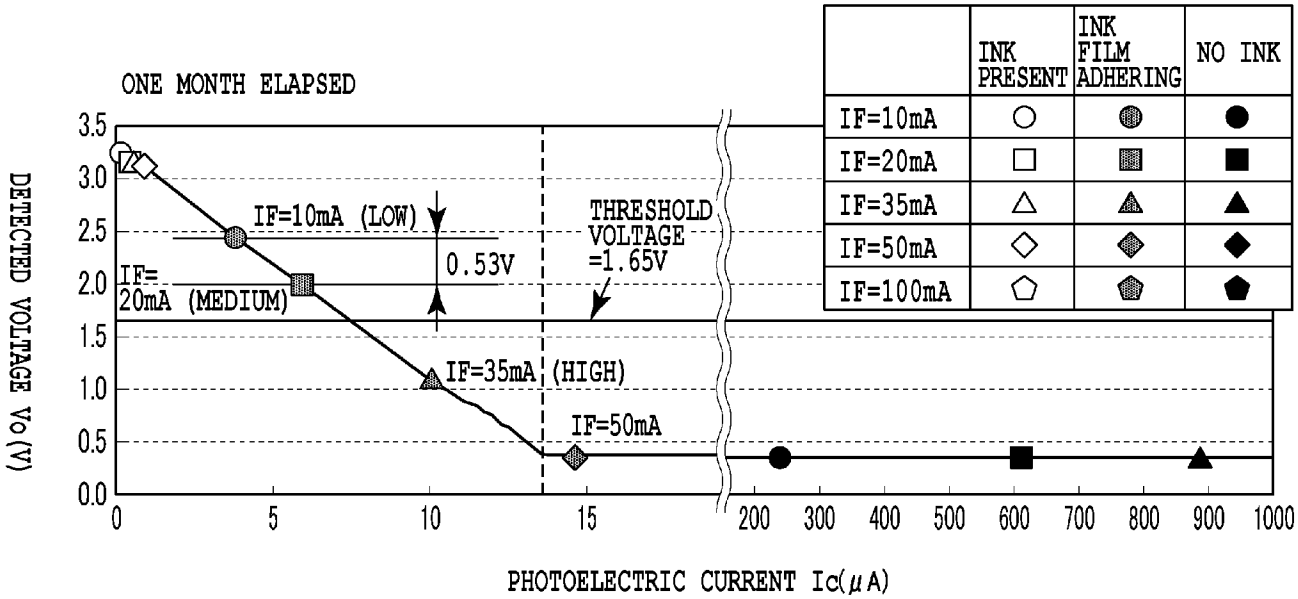
FIG. 15A to FIG. 15C are diagrams showing the relationship between the photoelectric current and the detected voltage according to the present embodiment.
Figure 15B:
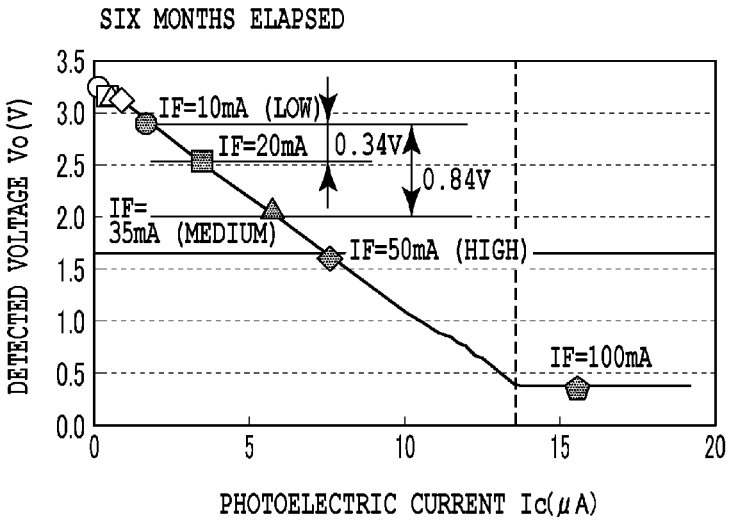
Figure 15C:
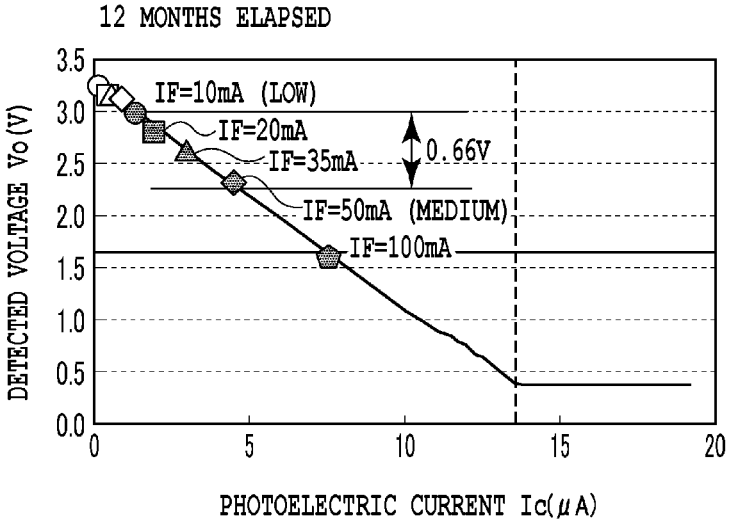

As shown in FIG. 14, the detected voltage of the phototransistor 40 decreases more slowly with respect to the forward current IF as the elapsed time from the date of manufacture to the current time increases. This indicates as follows. If the CPU 100 is configured to determine that the ink is exhausted when the ink voltage falls below a certain specified threshold partial voltage (for example, 1.65 V), a larger current needs to be applied to the light emitting diode 30 for the ink tank 24 with a longer elapsed time. FIG. 15A, FIG. 15B, and FIG. 15C show the results of reflecting the results shown in FIG. 14 in the relationship between the photoelectric current Ic and the detected voltage V0 in the phototransistor 40. FIG. 15A illustrates the use of the ink tank 24 with an elapsed time of one month. FIG. 15B illustrates the use of the ink tank 24 with an elapsed time of six months. FIG. 15C illustrates the use of the ink tank 24 with an elapsed time of 12 months.

With reference to FIG. 15A, the relationship between the photoelectric current Ic and the detected voltage Vo will be described taking, as an example, the ink tank 24 with an elapsed time of one month. With the ink in the ink tank 24 completely exhausted, when the forward current IF setting the emission intensity of the light emitting diode 30 to the low level is 10 mA, the photoelectric current Ic is 357 μA. Furthermore, when the forward current IF setting the emission intensity of the light emitting diode 30 to the medium level is 20 mA, the photoelectric current Ic is 714 μA. However, when the photoelectric current Ic reaches 13 μA, the detected voltage is saturated at 0.3V. A further increase in the forward current IF has no effect to change the detected voltage Vo.

In contrast, in an area where an ink film is formed, when the forward current IF setting the emission intensity of the light emitting diode 30 to the low level is 10 mA, the photoelectric current Ic is 3.7 μA, and the detected voltage Vo is 2.49 V. This indicates the result of a decrease in the amount of reflected light resulting from the formation of an ink film on the surface of the prism 14 as described above. Furthermore, when the forward current IF setting the emission intensity to the medium level is 20 mA, the detected voltage Vo is 1.96 V. In this case, the detected voltage Vo is also lower than in the ink exhausted state, but there is a voltage difference of 0.53 V in detected voltage between the case of IF=10 mA and the case of IF=20 mA. That is, in this case, the detected voltage Vo is outside the saturated region and is thus subjected to a marked voltage difference even with only a slight difference in photoelectric current Ic.

Thus, the difference in detected voltage between the irradiation of the prism 14 with light with the low emission intensity and the irradiation of the prism 14 with light with the medium emission intensity is more significant when an ink film is formed at the spot on the surface of the prism 14 where the prism 14 is irradiated with light from the light emitting diode 30 than when no ink is present on the surface of the prism 14. Thus, the CPU 100 determines that an amount of ink remains in the ink tank 24 if the difference in detected voltage between the case where the emission intensity with respect to the prism 14 is low and the case where the emission intensity with respect to the prism 14 is medium is smaller than the specified value (0.4 V). Furthermore, if the voltage difference is equal to or greater than the specified value (0.4 V), the CPU 100 determines that an ink film adheres to the prism surface.

Now, processing following step S15 will be described with reference to FIG. 11. If in step S14, the CPU 100 determines that the difference in detected voltage between the irradiation of the prism 14 with light with the low emission intensity and the irradiation of the prism 14 with light with the medium emission intensity is equal to or greater than 0.4 V, an ink film may adhere to the surface of prism 14. Thus, in this case, in step S15, the CPU 100 allows the light emitting diode 30 to emit light with the high emission intensity (FIG. 9) and determines whether or not the detected voltage Vo of the phototransistor 40 is equal to or lower than the threshold voltage (1.65 V) (step S17).

If the detected voltage Vo obtained at the high emission intensity is equal to or lower than the threshold voltage, the CPU 100 determines that the ink is exhausted to stop the printing operation (step S18). Furthermore, if the detected voltage Vo is equal to or greater than 1.65 V, the CPU 100 determines that an amount of ink is present (step S19). Thereafter, the CPU 100 shifts to step S15 to continue emitting light with the high emission intensity. In this case, the light emission with the high emission intensity is continued in order to carry out quick detection because if the difference in detected voltage between light emission with the low emission intensity and light emission with the medium emission intensity is equal to or greater than 0.3 V, the level of the ink in the ink tank 24 may be positioned at a height such that the level overlaps apart of the spot on the prism surface where the prism is irradiated with light.

In the example of the ink tank 24 with an elapsed time of one month, the forward current IF for light emission with the high emission intensity is 35 mA, and when the detected voltage Vo becomes equal to or lower than 1.65 V, the CPU 100 determines that the ink is exhausted to stop the printing operation. The present embodiment sets the threshold for the voltage difference between the light emission with the low emission intensity and the light emission with the medium emission intensity to 0.4 V. The threshold is set to 0.4 V because when light is emitted at the high emission intensity, for example, the photoelectric current Ic is increased by slight reflection of light having impinged on a surface other than the surfaces of the prism, resulting in a difference of about 0.3 V between the high level light and the low level light when an amount of ink is present.

The example of detection of the amount of ink remaining in the ink tank 24 with an elapsed time of one month from manufacture has been described. However, the table 2 in FIG. 9 is used for detection of the amount of ink remaining in the ink tank 24 with an elapsed time of six months shown in FIG. 15B. In the ink tank 24 with an elapsed time of six months, the ink adheres more firmly to the prism 14 and the detected voltage Vo varies less significantly with respect to the forward current IF, than in the ink tank 24 with an elapsed time of one month. A voltage difference of 0.4 V in detected voltage cannot be achieved using a forward current IF of 10 mA and a forward current IA of 20 mA. Hence, if the ink tank 24 with an elapsed time of six months is used, then according to the settings in the table 2, a current of 35 mA is passed through the light emitting diode 30 as the forward current IF providing light emission with the medium emission intensity. Thus, even the ink tank with an elapsed time of six months can provide a voltage difference of 0.84 V in detected voltage between the light emission with the low emission intensity and the light emission with the medium emission intensity. Consequently, as described above, the light emissions with the low and medium emission intensities are repeated, and when the voltage difference reaches 0.4 V, the light emission with the high emission intensity is provided. The forward current for the light emission with the high emission intensity is 50 mA as shown in the table 2. At this time, the detected voltage V0 is 1.65 V. As described above, even if the ink film adheres firmly, the presence or absence of ink can be accurately detected early by increasing the level of the emission intensity. To allow the presence or absence of ink in the ink tank 24 with an elapsed time of 12 months to be detected, the table 3 in FIG. 9 is selected and the forward currents for the light emissions with the medium and high emission intensities are further increased. That is, as shown in FIG. 15C, the forward current for the light emission with the low emission intensity is 10 mA, the forward current for the light emission with the medium emission intensity is 20 mA, and the forward current for the light emission with the high emission intensity is 50 mA. Then, as shown in FIG. 15C, a voltage difference of 0.66 V in detected voltage can be achieved between the light emission with the low emission intensity and the light emission with the medium emission intensity. Therefore, the amount of remaining ink can be accurately detected early by switching to the light emission with the high emission intensity when a voltage difference of at least 0.4 V in detected voltage is reached between the light emission with the low emission intensity and the light emission with the medium emission intensity.

As described above, the present embodiment repeats the light emissions with the low and medium emission intensities until the amount of ink remaining in the ink tank 24 becomes equal to or smaller than the specified value, and switches to the light emission with the high emission intensity when the amount becomes equal to or smaller than the specified value. Thus, compared to the conventional technique for detecting the amount of remaining ink which technique constantly provides the light emission with the high emission intensity, the present embodiment significantly extends the life of the light emitting diode 30 and also allows the absence of ink to be accurately detected without causing a marked delay in the detecting operation.

FIG. 16A, FIG. 16B, FIG. 17A, and FIG. 17B show the results of the operation of detecting the amount of remaining ink according to the present embodiment performed on the ink tank 24 with an elapsed time of at most one month from the date of manufacture and on the ink tank 24 with an elapsed time of six months from the date of manufacture.

Figure 16A:
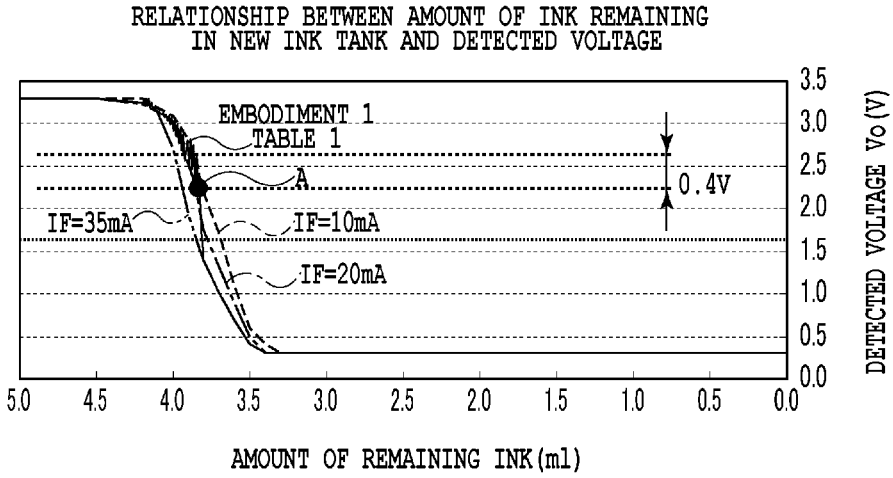
FIG. 16A and FIG. 16B are diagrams showing the relationship between the amount of remaining ink and the detected voltage of the light receiving circuit according to the present embodiment.

FIG. 16A and FIG. 17B are diagrams showing the results of measurement of the relationship between the amount of remaining ink and the detected voltage observed when the ink in the ink tank 24 installed in the main body section 1 of the printing apparatus is consumed. FIG. 16A shows the results of measurement for the new ink tank 24 with an elapsed time of at most one month from the date of manufacture. In this case, the table 1 in FIG. 9 is used as a combination of forward currents for driving the light emitting diode 30. Furthermore, FIG. 16A also shows the results of measurements with only one of the low emission intensity (IF=10 mA), the medium emission intensity (IF=20 mA), and the high emission intensity (IF=35 mA) used for each measurement.

In the new ink tank 24, the ink leaves the prism surface almost simultaneously with a decrease in the level of the ink. Thus, for all of the light emissions with the low, medium, and high emission intensities, the detected voltage Vo varies sharply from the maximum value to the minimum value. According to the present embodiment, the detected voltage corresponding to the light emission with the low emission intensity alternated with the detected voltage corresponding to the light emission with the medium emission intensity, and when a remaining amount A in FIGS. 16A and 17B was reached, the voltage difference in detected voltage between the light emission with the low emission intensity and the light emission with the medium emission intensity became 0.4 V. Thus, when the remaining amount A was reached, the light emission switched to the high intensity.

FIG. 17A shows the amount of remaining ink measured when the threshold voltage (1.65 V) was reached and the amount of remaining ink measured when the threshold voltage was reached as a result of independent light emissions with the low, medium, and high emission intensities, respectively. As shown in FIG. 17A, according to the present embodiment, in which the forward voltage IF was changed according to the table 1, the threshold voltage (1.65 V) was reached when the amount of remaining ink became 3.80 ml. In contrast, the amounts of ink remaining at which the threshold voltage was reached as a result of independent light emissions with the low, medium, and high emission intensities were 3.67 ml, 3.77 ml, and 3.85 ml, respectively. The results indicate that the present embodiment allows the absence of ink to be detected at the second early timing next to the case where the detection is carried out using only the light emission with the high emission intensity.

Figure 16B:
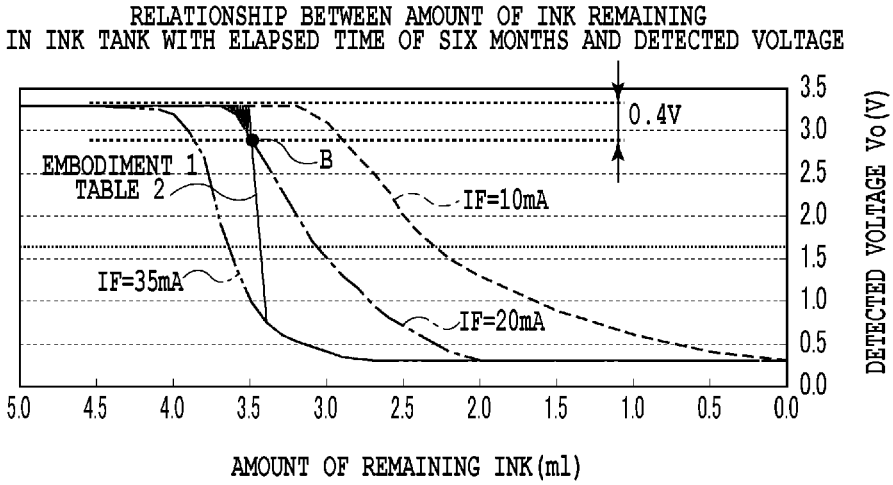

FIG. 16B shows the results of experiments which are similar to the experiments illustrated in FIG. 16A and which use the ink tank 24 left unattended for six months. In this ink tank 24, the ink is fixed to the surface of the prism 14, and a long time elapses after the ink in the liquid chamber 1*a* is exhausted and before the ink leaves the prism surface. Thus, there was a significant difference in time until the threshold voltage is reached depending on the difference in the emission intensity of the light emitting diode 30. For this ink tank 24, the table 2 was used to vary the emission intensity (vary the forward current). That is, IF was 10 mA for the low emission intensity, IF was 35 mA for the medium emission intensity, and IF was 50 mA for the high emission intensity. For comparison with the present embodiment, FIG. 16B also shows the results of independent light emissions with the low, medium, and high emission intensities. According to the present embodiment, the detected voltage corresponding to the light emission with the low emission intensity alternated with the detected voltage corresponding to the light emission with the medium emission intensity, and when a remaining amount B in FIGS. 16A and 17B was reached, the voltage difference in detected voltage between the light emission with the low emission intensity and the light emission with the medium emission intensity became 0.4 V. At this time, the light emission switched to the high intensity. Thus, the present embodiment can detect the absence of ink at a significantly early timing compared to the case where the detection is carried out using only the light emissions with the low and medium emission intensities. FIG. 17B shows the amount of remaining ink measured when the threshold voltage was reached. As shown in FIG. 17B, when the amount of remaining ink measured when the threshold voltage is reached is compared between independent light emissions with the low, medium, and high emission intensities and the light emission according to the present embodiment, the difference is more significant than in FIG. 17A. That is, the present embodiment allows the presence of ink to be detected more early than the independent light emissions with the low and medium emission intensities, and the difference in the timing of the detection is more significant with the ink tank 24 with a longer elapsed time from the date of manufacture.

Figure 18:
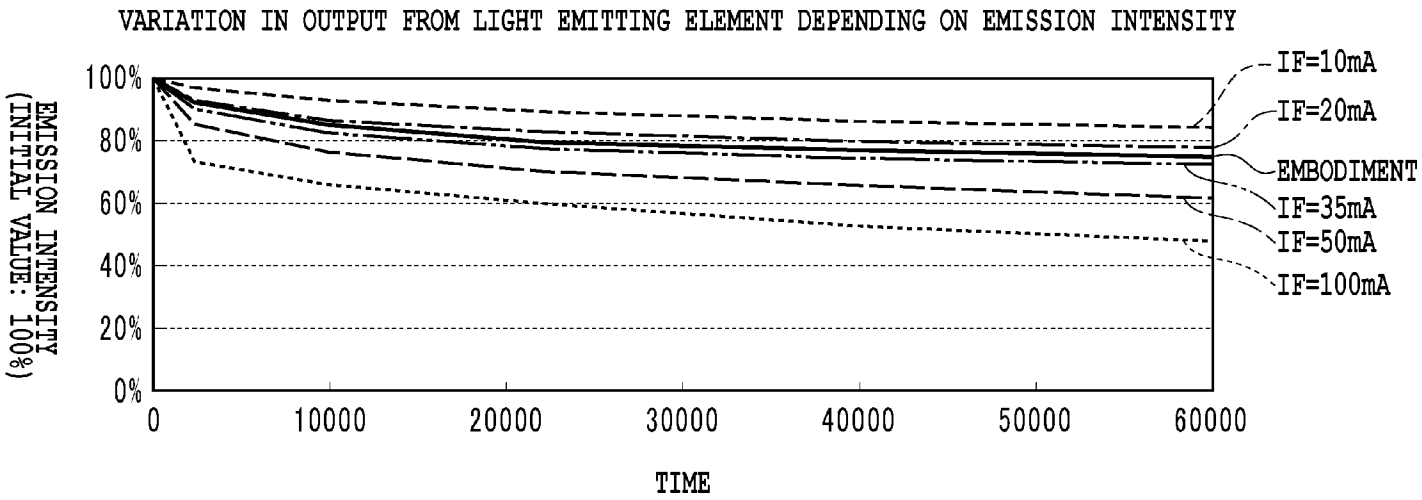
FIG. 18 is a diagram showing a variation in output from the light emitting element at each emission intensity.

FIG. 18 shows a graph of the life curve of the light emitting element. In the light emitting diode 30, deterioration of the light emitter progresses with increasing time for current conduction, thus reducing power. The life of the light emitting diode 30 normally corresponds to the time when the emission intensity in its initial state decreases down to 80%. FIG. 18 shows the relationship between the time for current conduction and the emission intensity observed when the light emitting diode 30 was allowed to emit light. FIG. 18 shows two cases for this measurement: the case in which the light emitting diode 30 was driven in accordance with the control of the present embodiment and the case in which light emitting diode 30 was driven with forward current IF fixed to each of 10 mA, 20 mA, 35 mA, 50 mA, and 100 mA. Furthermore, the measurement according to the present embodiment was carried out under average conditions where the new ink tank 24 with an elapsed time of at most one month from the date of manufacture, the ink tank 24 with an elapsed time of six months from the date of manufacture, and the ink tank 24 with an elapsed time of one year from the date of manufacture were used at equivalent rates As shown in FIG. 18, if the light emitting diode 30 is driven with the forward current IF fixed, the rate of decrease in output per time increases consistently with the emission intensity. In particular, if the light emitting diode 30 is driven using the forward currents of 35 mA, 50 mA, and 100 mA, which are used for the light emission with the high emission intensity, the output falls outside the usable range, that is, decreases below 80%, early. However, as shown in FIG. 19, the case where the light emitting element was driven under the control of the present embodiment underwent the second insignificant decrease in emission intensity next to the case where the light emission was fixed to the low emission intensity (IF=20 mA).

The above-described measurement results indicate that light emission in the appropriate amount at the appropriate timing according to the present embodiment inhibits a possible delay in detection caused by adhesion of ink to the prism surface and prevents a possible decrease in the life of the light emitting element.

Other Embodiments of the Invention

The above-described embodiment sets three of the five levels of emission intensity to be the low, medium, and high emission intensity based on the elapsed time of the ink tank 24 from the date of manufacture to the current time. However, if the ink is unlikely to be altered or a large amount of ink is consumed leading to frequent replacements of the ink tank 24, the three levels of emission intensity, the low, medium, and high emission intensity, may be fixed to certain values. Alternatively, the emission intensity of the light emitting diode 30 may be switched among four or at least six levels. Moreover, the switching of the emission intensity of the light emitting diode 30 is not limited to the switching of the current limiting resistor connected to the light emitting diode 30 as in the case of the above-described embodiment. The switching may be carried out according to a well-known PWM scheme.

Moreover, the present invention is not limited to the switching among the three levels of emission intensity, the low, medium, and high emission intensities, which switching is carried out during the use of the ink tank 24. That is, the presence or absence of ink can be detected by switching the emission intensity among at least four levels of emission intensity. For example, the emission intensity can be switched among four levels, that is, a low emission intensity, a medium low emission intensity, a medium emission intensity, and a high emission intensity. In this case, in the beginning of the use, the following control is repeated: the emission intensity of the light emitting element is sequentially switched among at least two levels, for example, among the low, medium low, and medium emission intensities. Then, when the voltage difference between two of three detected voltages associated with the three levels of emission intensity reaches a specified value, the light emission is switched to the high emission intensity. Possible combinations of two detected voltages for the voltage difference include, for example, a combination of the detected voltage associated with the light emission with the low emission intensity and the detected voltage associated with the light emission with the medium emission intensity and a combination of the detected voltage associated with the light emission with the medium low emission intensity and the detected voltage associated with the light emission with the medium emission intensity. Another possible combination is the detected voltage associated with the detected voltage associate with the light emission with the medium low emission intensity and the detected voltage associated with the light emission with the medium emission intensity. Then, when the voltage difference between at least one combination of the detected voltages reaches a preset value, the light emission is switched to the high emission intensity. This allows more assured switching to the light emission with the high emission intensity to be achieved, resulting in higher reliability.

The above-described embodiment changes the emission intensity of the light emitting element is changed according to the elapsed time of the ink tank 24. However, the emission intensity of the light emitting element may be controlled with conditions other than the elapsed time of the ink tank 25 taken into account.

Figure 20A:
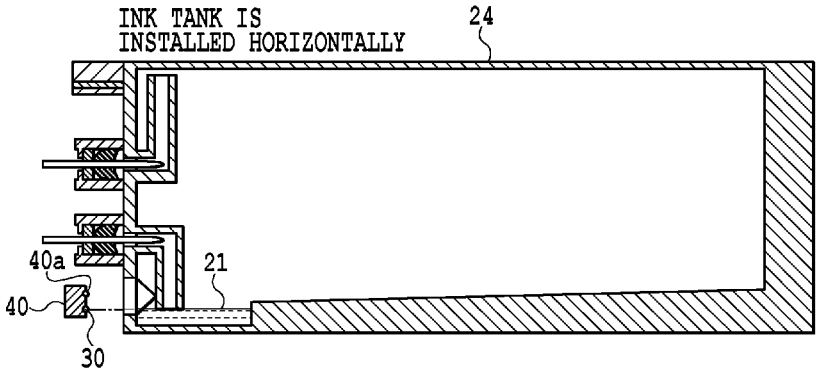
FIG. 20A to FIG. 20C are diagrams showing the relationship between the inclination of an ink tank and the amount of remaining ink when the absence of ink is detected.
Figure 20B:
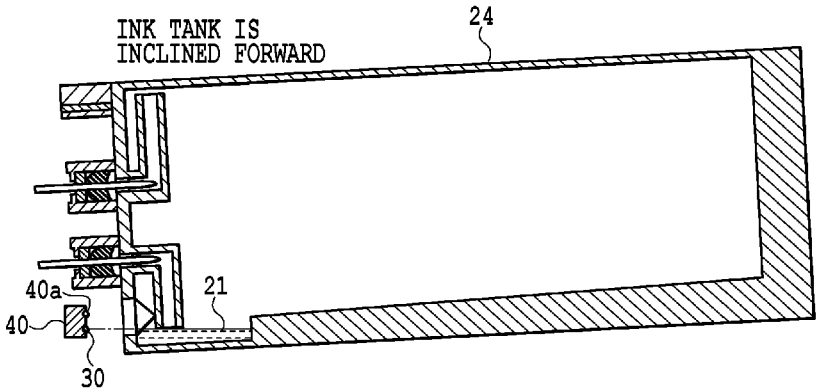
Figure 20C:
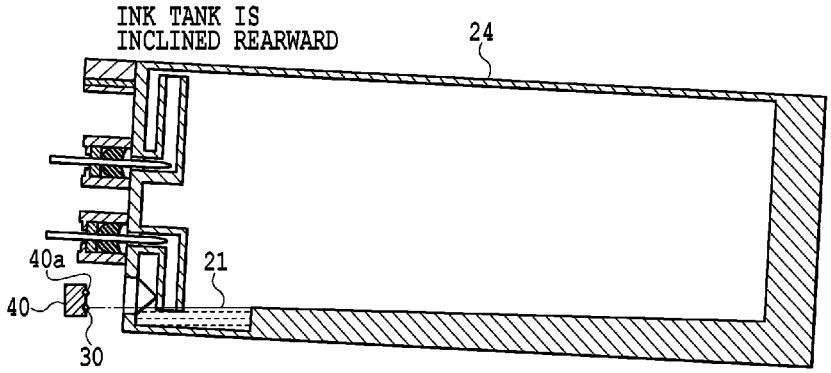

For example, the emission time of the light emitting element may be measured by the CPU 100 so that the emission intensity of the light emitting element can be increased every time the measured elapsed time increments by a specified value. Moreover, an environment sensor may be provided which detects the environmental temperature around the ink tank 24 or the ink jet printing apparatus so that the emission intensity of the light emitting element can be controlled based on the environmental temperature. Furthermore, when the current posture of the ink tank 24 during use is inclined to the reference posture of the main body section of the printing apparatus or the ink tank 24, the amount of remaining ink may be excessively small when the level corresponding to the ink exhausted state is reached as shown in FIG. 20A to FIG. 20C. In this case, the print head 25 is likely to suck the air, thus requiring earlier detection. Hence, an inclination detection means for detecting the degree of inclination may be provided so that the emission intensity of the light emitting diode 30 can be changed based on the result of the detection. When FIG. 20A is assumed to show the ideal installation state of the ink tank 24, FIG. 20B and FIG. 20C show that the ink tank 25 is inclined to the horizontal plane. Consequently, air is likely to enter the ink tank 24 through the opening end 8*a* thereof. In this state, if the ink adhering to the prism 14 delays the timing of detecting the absence of ink, the air may be sucked through the opening end 8*a*. To avoid this, the CPU 100 may controllably increase the emission intensity of the light emitting diode 30 if inclination detection means detects when the ink tank 24 or the ink jet printing apparatus main body is inclined at a predetermined angle or more.

As described above, the presence or absence of ink can be more accurately detected by controlling the emission intensity with conditions other than the elapsed time of the ink tank 24 taken into account.

Furthermore, the above-described embodiment determines whether or not the ink in the liquid chamber is exhausted by arranging the reflection surface 14*a* of the prism 14, serving as a reflector, at the same position as that of the inclined surface 7 forming the bottom of the liquid chamber of the ink tank 24 or a position below the inclined surface 7. However, the present invention is not limited to the detection of the presence or absence of ink in the ink tank 24 or the liquid chamber. That is, the present invention determines whether or not the amount of ink remaining in the ink tank 24 is smaller than a predetermined value and allows the amount of remaining ink serving as reference for detection (predetermined amount) to be varied depending on the position where the reflector is provided. For example, the present invention can determine whether the amount of remaining ink is less than 20%, 30%, or 50% of the volume of the ink tank 24, and the above-described predetermined amount can be optionally set.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-155587, filed Jul. 14, 2011, which is hereby incorporated by reference herein in its entirety.

What is claimed is:

1. An ink remaining amount detecting device that determines whether or not an amount of ink remaining in an ink tank is smaller than a predetermined amount, the device comprising:

a reflector provided in the ink tank and in which an optical reflectance obtained in a case where an amount of ink remaining in the ink tank is smaller than the predetermined amount is higher than an optical reflectance obtained in a case where an amount of ink remaining in the ink tank is equal to or larger than the predetermined amount;

a light emitting unit configured to generate light allowed to enter the reflector;

a light receiving unit configured to receive light reflected by the reflector and outputting an output signal according to an amount of received reflected light;

a control unit configured to perform light emission control that switches an emission intensity of the light emitting unit among a plurality of levels; and a determination unit configured to determine whether or not an amount of ink remaining in the ink tank has reached the predetermined amount based on an output signal output by the light receiving unit, wherein the determination unit determines whether or not a difference between output signals each output by the light receiving unit according to a corresponding each of at least two of the plurality of levels of light emissions has reached a specific value, the control unit switches an emission intensity of the light emitting unit to a higher level than the levels of the two light emissions in a case where the determination unit determines that a difference of output signals has reached the specific value, and the determination unit determines that an amount of remaining ink has reached the predetermined amount in a case where an output signal output by the light receiving unit according to light with the higher emission intensity generated by the light emitting unit has reached a preset threshold value.

2. The ink remaining amount detecting device according to claim 1, wherein the control unit increases the emission intensity of at least one of the plurality of levels according to an elapsed time of the ink tank from a date of manufacture to a current time.

3. The ink remaining amount detecting device according to claim 1, further comprising read unit configured to read a date of manufacture stored in a storage element provided in the ink tank, and the control unit calculates an elapsed time from a date of manufacture to a current time read from the storage element.

4. The ink remaining amount detecting device according to claim 1, wherein the light emitting unit comprises a light emitting diode, a current limiting resistor that limits a current flowing through the light emitting diode, and a power source that applies a voltage to the light emitting diode via the current limiting resistor, and the control unit switches the emission intensity of the light emitting diode by switching a value for the current limiting resistor.

5. The ink remaining amount detecting device according to claim 1, wherein the reflector is formed of a transparent material provided integrally with the ink tank, and the transparent material has a refractive index of at least 1.40 and less than 1.87.

6. The ink remaining amount detecting device according to claim 1, wherein the reflector is shaped like a triangle pole with a cross section shaped like a right-angled isosceles triangle, and comprises two orthogonal reflection surfaces projecting inside the ink tank and a bottom surface located opposite a ridge where the two reflection surfaces cross each other at right angles, the bottom surface being arranged to face an outside of the ink tank, light generated by the light emitting element enters the reflector at a right angle to the bottom surface, and the light receiving unit receives light reflected by the two reflection surfaces.

7. The ink remaining amount detecting device according to claim 1, wherein the control unit increases the emission intensity of the light emitting unit every time an elapsed emission time of the light emitting unit increases by a specified value.

8. The ink remaining amount detecting device according to claim 1, wherein the emission intensity of the light emitting unit is controlled based on an environment temperature around the ink tank.

9. The ink remaining amount detecting device according to claim 1, further comprising detection unit configured to detect an inclination of a current posture of the ink tank during use with respect to a posture during use which serves as a reference for the ink tank, and the emission intensity of the light emitting unit is controlled according to the inclination detected by the detection unit.

10. An ink remaining amount detecting method for determining whether or not an amount of ink remaining in an ink tank is smaller than a predetermined amount, the method comprising:

a control step of performing light emission control that switches, among two levels, an emission intensity of the light allowed to enter a reflector in which an optical reflectance obtained in a case where an amount of ink remaining in the ink tank is smaller than the predetermined amount is higher than an optical reflectance obtained in a case where an amount of ink remaining in the ink tank is equal to or larger than the predetermined amount; and a first determining step of determining whether or not a difference between output signals each output by a light receiving unit configured to receive light reflected by the reflector according to a corresponding each of at least two of the plurality of levels of light emission has reached a specific value, a switching step of switching an emission intensity of a higher level than the levels of the two light emissions in a case where the first determining step determines that the difference of the output signals has reached the specific value, and a second determining step of determining that an amount of remaining ink has reached the predetermined amount in a case where an output signal output by the light receiving unit according to light with the higher emission intensity has reached a preset threshold value.

11. An ink jet printing apparatus comprising an ink tank in which ink is stored, a print head that ejects ink fed from the ink tank, and ink remaining amount detecting unit configured to determining whether or not an amount of ink remaining in the ink tank is smaller than a predetermined amount, wherein the ink remaining amount detecting unit comprises:

a reflector provided in the ink tank and in which an optical reflectance obtained in a case where an amount of ink remaining in the ink tank is smaller than the predetermined amount is higher than an optical reflectance obtained in a case where an amount of ink remaining in the ink tank is equal to or larger than the predetermined amount;

light emitting unit configured to generate light allowed to enter the reflector;

light receiving unit configured to receive light reflected by the reflector and outputting an output signal according to an amount of received reflected light;

control unit configured to perform light emission control that switches an emission intensity of the light emitting unit among a plurality of levels; and determination unit configured to determine whether or not an amount of ink remaining in the ink tank has reached the predetermined amount based on an output signal output by the light receiving unit, wherein the determination unit determines whether or not a difference between output signals each output by the light receiving unit according to a corresponding each of at least two of the plurality of levels of light emissions has reached a specific value, the control unit switches an emission intensity of the light emitting unit to a higher level than the levels of the two light emissions in a case where the determination unit determines that a difference of output signals has reached the specific value, and the determination unit determines that an amount of remaining ink has reached the predetermined amount in a case where an output signal output by the light receiving unit according to light with the highest emission intensity generated by the light emitting unit has reached a preset threshold value.

* * * * *

UNITED STATES PATENT AND TRADEMARK OFFICE

CERTIFICATE OF CORRECTION

PATENT NO. : 8,770,688 B2
APPLICATION NO. : 13/544704
DATED : July 8, 2014
INVENTOR(S) : Kenro Yamaguchi and Takashi Sugai It is certified that error appears in the above-identified patent and that said Letters Patent is hereby corrected as shown below:

Title page, item (73) Assignee, change "Canon Finetech Inc., Joso-Shi (JP)" to
-- Canon Finetech Inc., Misato-Shi (JP) --

Signed and Sealed this
Twenty-fifth Day of November, 2014

Michelle K. Lee

Michelle K. Lee
*Deputy Director of the United States Patent and Trademark Office*